US006375569B2

(12) United States Patent
Acres

(10) Patent No.: US 6,375,569 B2
(45) Date of Patent: Apr. 23, 2002

(54) OPERATION OF GAMING MACHINES IN A LINKED BONUS PRIZE WINNING MODE

(75) Inventor: John F. Acres, Corvallis, OR (US)

(73) Assignee: Acres Gaming, Inc., Las Vegas, NV (US)

( * ) Notice: Subject to any disclaimer, the term of this patent is extended or adjusted under 35 U.S.C. 154(b) by 0 days.

(21) Appl. No.: 09/075,153

(22) Filed: May 8, 1998

(30) Foreign Application Priority Data

May 9, 1997 (AU) ..... PO6741

(51) Int. Cl.[7] ..... A63F 9/24
(52) U.S. Cl. ..... 463/27; 463/25
(58) Field of Search ..... 463/25, 26, 27, 463/16–22, 28, 30, 40, 42

(56) References Cited

U.S. PATENT DOCUMENTS

| | | | | |
|---|---|---|---|---|
| 4,624,459 A | * | 11/1986 | Kaufman | 463/20 |
| 4,669,731 A | * | 6/1987 | Clarke | 463/20 |
| 4,837,728 A | * | 6/1989 | Barrie et al. | 463/27 |
| 5,042,810 A | * | 8/1991 | Williams | 463/17 |
| 5,083,785 A | * | 1/1992 | Okada | 463/21 |
| 5,655,961 A | | 8/1997 | Acres | 463/27 |
| 5,695,402 A | * | 12/1997 | Stupak | 463/20 |
| 5,885,158 A | * | 3/1999 | Torango et al. | 463/27 |
| 6,012,982 A | * | 1/2000 | Piechowiak et al. | 463/16 |

FOREIGN PATENT DOCUMENTS

| | | |
|---|---|---|
| AU | B-53370/86 | 8/1986 |
| AU | B-13023/92 | 9/1992 |
| AU | A-70247/96 | 4/1997 |

* cited by examiner

*Primary Examiner*—Joe H. Cheng
*Assistant Examiner*—Kim T. Nguyen
(74) *Attorney, Agent, or Firm*—Marger Johnson & McCollom, PC

(57) ABSTRACT

A gaming machine system having a bonus prize award mode in the play of gaming machines is disclosed. Interface units each are coupled to a respective gaming machine to receive a play signal that includes the identity of the respective machine. A central processor, that includes a data memory is linked to each of the interface units. The system is operable by the processor executing a first prize accumulation phase during which a value is added to an initial value for each play signal up to a level where the accumulating value equals a prize value that will be awarded to one of the gaming machines, and executing a second prize award winning phase during which the accumulated value remains frozen and subsequent plays of the gaming machines are separately counted for their occurrence. The play of a gaming machine causing the count to equal a prize win count value results in that gaming machine being awarded the prize value.

19 Claims, 3 Drawing Sheets

OPERATION OF GAMING MACHINES IN A LINKED BONUS PRIZE WINNING MODE

FIELD OF THE INVENTION

This invention relates to the field of gaming machines, and particularly to a number of such machines that are linked in a network sense to provide a bonus prize winning mode of operation. The bonus prize winning mode is additional to wins occurring in play of the normal game(s) provided by each gaming machine. In one particular form the gaming machines are spinning reel or card-type machines commonly known as slot or fruit machines.

DESCRIPTION OF THE PRIOR ART

It is known to provide systems that implement bonus prize winning modes apart from the normal games available for play on a gaming machine. Such systems typically comprise a bank of gaming machines each having an interface providing communication with a central controlling computer or data processor. The controlling computer receives from each connected gaming machine an indication of each play (and possibly also the wager value). A bonus prize pool is formed and accumulates with each play of the gaming machines. This accumulating total most usually is prominently displayed on a visual display unit. The bonus pool is awarded when it reaches a (usually) randomly chosen value, being won by the player of the machine whose play caused the total to be reached. Examples of such prior art arrangements can be noted in Australian Patents Nos. 589158 and 655801.

Another prior art arrangement is described in published Australian Patent Application No. 70247/96.

A key motivation or desire of operators of licensed premises in which gaming machines are placed is to encourage the machines to be in use as much as possible since usage directly affects the revenue gained. As such a bonus prize winning scheme encourages and promotes usage by the prospect of a windfall prize independent of prizes won in normal play of the gaming machines. It is accordingly desired to develop improved methods of operating a prize winning mode to encourage greater machine usage, also to provide enhanced enjoyment for the players. The present invention seeks to achieve these objectives.

SUMMARY OF THE INVENTION

Therefore, the invention, in one broad form, discloses a method for awarding a bonus prize in the play of a plurality of gaming machines, the gaming machines being linked to a central processor having a data memory, the method comprising the steps of:

- transmitting, on play of any one gaming machine, a signal therefrom to said central processor, said signal including the identity of the respective gaming machine;
- registering each said play signal as an entry in said memory with said identity of the respective gaming machine;
- executing a first prize accumulation phase during which a value is added to an initial value for each play signal entry up to a level where the accumulating value equals a prize value that will be awarded to one of the linked gaming machines; and
- executing a second prize awarding phase during which said accumulated value remains frozen, and subsequent plays of one or more of the gaming machines are separately counted for their occurrence, and a play of a gaming machine causing the count to equal a prize win count value results in that gaming machine be awarded said prize value.

In one advantageous form there comprises the further step of displaying the awarding of said prize value on an indicator means and/or the respective gaming machine.

The invention further discloses a gaming machine system having a bonus prize awarding mode in the play of gaming machines, the system comprising:

- a plurality of gaming machines for playing games thereon;
- a plurality of interface units each coupled with a respective gaming machine to receive a play signal therefrom including the identity of the respective gaming machine;
- a central processor having a data memory and being linked to said interface units to receive said play signals; and
- indicator means lined with said central processor;
- and wherein said system is operable by said central processor executing a first prize accumulation phase during which a value is added to an initial value for each said play signal entry up to a level where the accumulating value equals a prize value that will be awarded to one of the linked gaming machines, causing said accumulating value to be displayed on said indicator means, and executing a second prize awarding phase during which said accumulated value remains frozen, and subsequent plays of the gaming machines leading to subsequent memory entries are separately counted for their occurrence, and a play of a gaming machine causing the count to equal a prize win count value results in that gaming machine be awarded said prize value.

Preferably, said indicator means and/or the respective gaming machine displays the awarding of said prize value.

Both the method and system of the invention can provide that the play signals generated in the prize accumulation and/or prize awarding phases are based on any one or more of coin-in, coin-out, play duration and quantum of wagers. The prize awarding phase further can be based on a chosen fixed value of play signals.

BRIEF DESCRIPTION OF THE DRAWINGS

An embodiment of the invention will now be described with reference to the accompanying drawings, in which.

DESCRIPTION OF PREFERRED EMBODIMENTS

Figure 1:
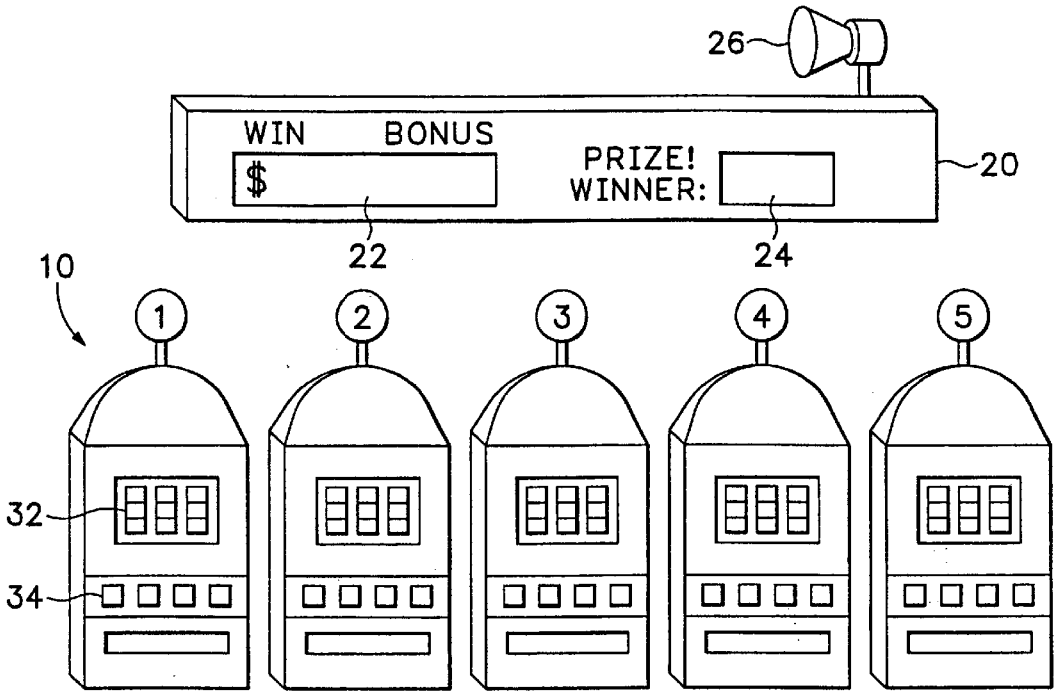
FIG. 1 shows a general arrangement of components of a bonus prize award winning system.

As shown in FIG. 1, a bonus prize award winning system 10 comprises five gaming machines 1–5 in a bank or row configuration. These gaming machines allow the players thereof to participate in the bonus prize winning feature. The gaming machines 1–5 can be situated in a casino or other licensed premises. There may be other such gaming machines that do not allow players to participate in the bonus prize winning feature. Alternatively, in a site of some hundreds of gaming machines, all could participate in the feature.

Each of the gaming machines provides for the play of a game such as a spinning reel or simulated poker card game. Each gaming machine 1–5 is played independently of any other, although the individual plays collectively contribute to the bonus prize winning feature.

A display unit 20 is located above the gaming machines 1–5 to provide visual and audible indications to players of the progress and completion of the bonus prize winning feature. The display unit includes a prize value display 22, a winning machine display 24 and a horn loudspeaker 26, the functions of which will be described presently.

Each gaming machine has an internal processor 30 (not shown), a reel display unit 32 by which a player observes the game play and a series of inputs 34 such as game operation pushbuttons and a coin acceptor (or card equivalent) for wagering on plays of the game.

Figure 2:
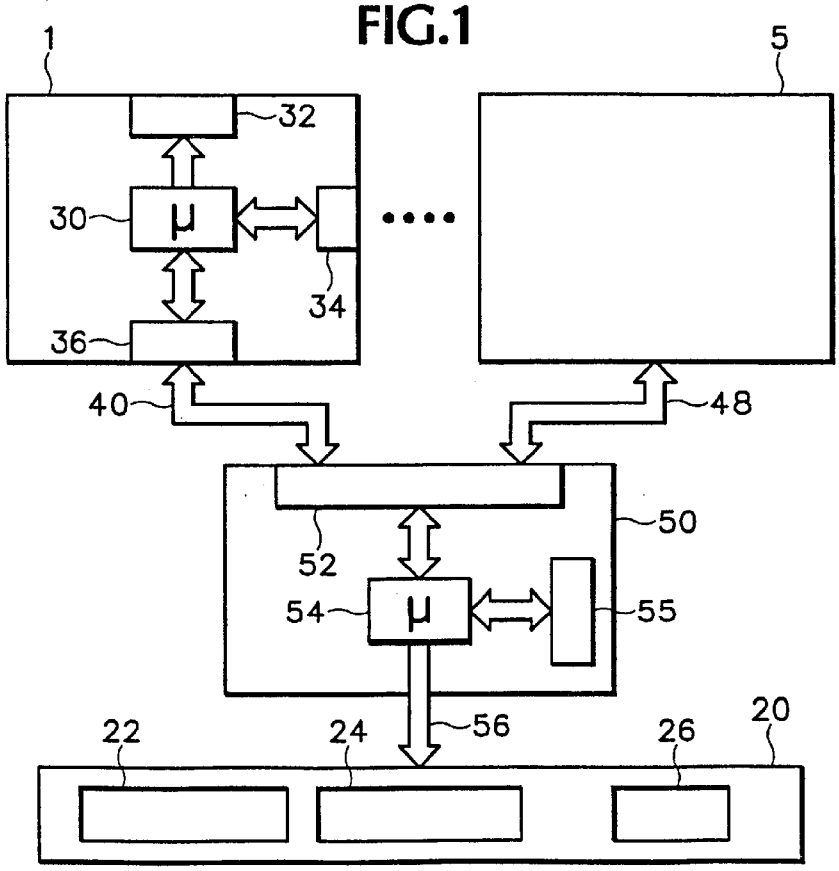
FIG. 2 shows a schematic block diagram of a bonus prize award winning system embodying the invention.

Referring now to FIG. 2, there is shown a schematic block diagram of the system 10. Each of the gaming machines 1–5 further comprises an interface unit 36 providing communication between the processor 30 by a respective data link 40,42,44,46,48. These links communicate with a central controlling unit 50, having an interface unit 52, a processor 54 and an associated memory 55. The processor 54 in turn communicates with the display unit 20 by a further data link 56.

The gaming machines can be the Game King™ type of machine manufactured by the present co-applicant I.G.T. (Australia) Pty Limited. The data links, central control unit 50 and the display unit 20 can be of any of the types manufactured by and available from the other co-applicant, Acres Gaming Inc. The bonus prize winning methodology is, in large measure, achieved by programming of the central processor 54.

Figure 3:
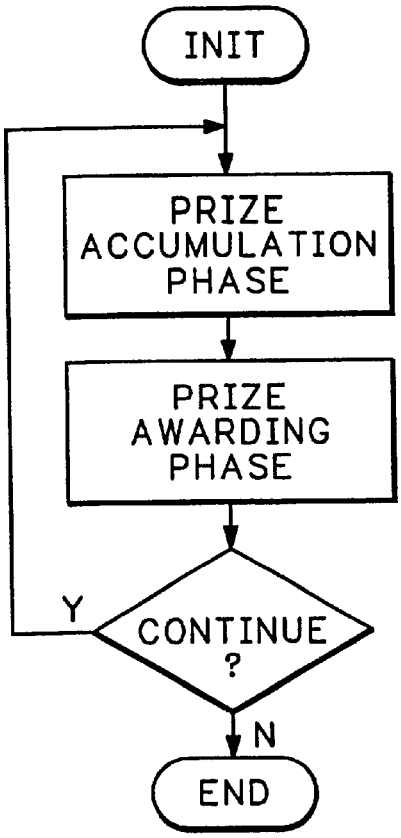
FIG. 3 is a flow diagram of the bonus prize winning cycle.

The bonus prize winning operation is performed in discrete cycles, each of which contains two sequential phases, as shown generally in the flow diagram of FIG. 3. Upon initialization, the prize accumulation phase takes place followed by the prize awarding phase, at which time the bonus prize is awarded. If the operation is to continue the cycle repeats. The "continue" test is under the control of a system operator having control over the central controlling unit 50.

Figure 4:
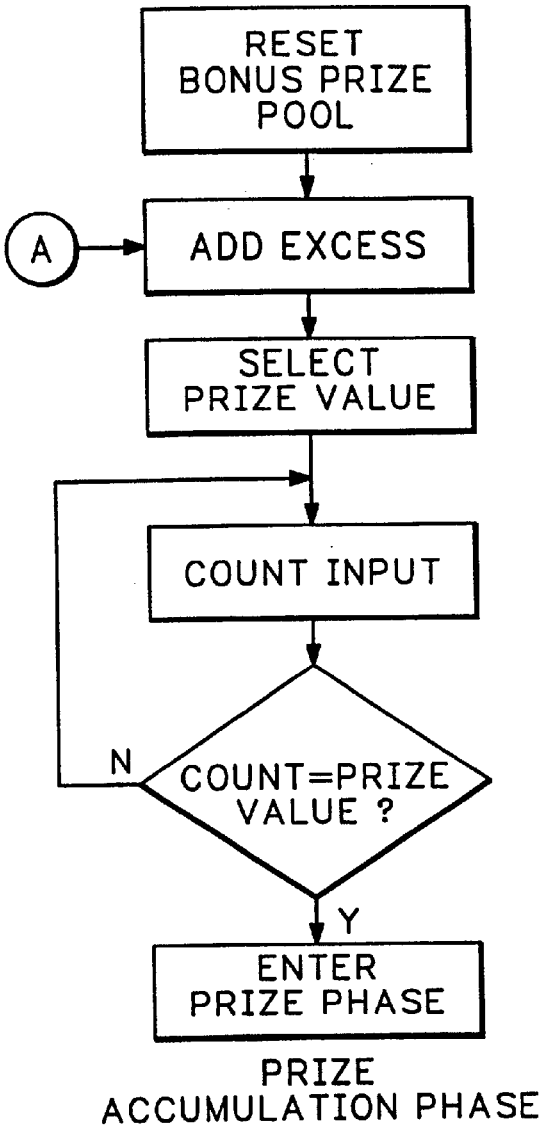
FIG. 4 is a flow diagram of the prize accumulation prize.

FIG. 4 shows the prize accumulation phase in greater detail. Firstly, a "bonus pool" is reset to an initial value typically chosen in a range. For the purposes of explanation, let the range be in the range $100–$500 representing the possible prizes that can be won. The prize need not only be in a monetary denomination, rather can be in any form of units or points have money or money's-worth. The initial value is chosen to be $100.00.

Next, any "excess" is added to the initial value. For the first cycle the excess value will be $0.00. This aspect will be returned to later.

Next, the prize value is selected as a random value in the range of values (initial value+excess) to the maximum value, ie. $100–$500, and for example is $450.25.

Next, each play of any of the gaming machines 1–5, resulting in a play signal on lines 40–48, is counted in a cumulative manner as an event. This can be either as plays of the game and/or units wagered. In the present case, each count accumulates as a percentage of the monetary units wagered, ie. 2%. The prize pool thus grows with play of each gaming machine, and with each input the identity (ie. machine number) of the respective gaming machine is also noted and stored in the memory (possibly only temporarily).

The accumulating total is displayed on the prize value display.

Next, the central processor checks on each input whether the count equals the prize value of $450.25. When this condition is satisfied, the bonus prize is 'frozen' as is the state of the prize value display 22. Also, a visual and/or audible indication of the bonus prize value having been reached is given by flashing lights or bells, for example. It is important to realize that the bonus prize value is not awarded as a matter of course to the player of the gaming machine whose play has taken the accumulated pool to the prize value, as is the case for the prior art Australian patents noted above.

Figure 5:
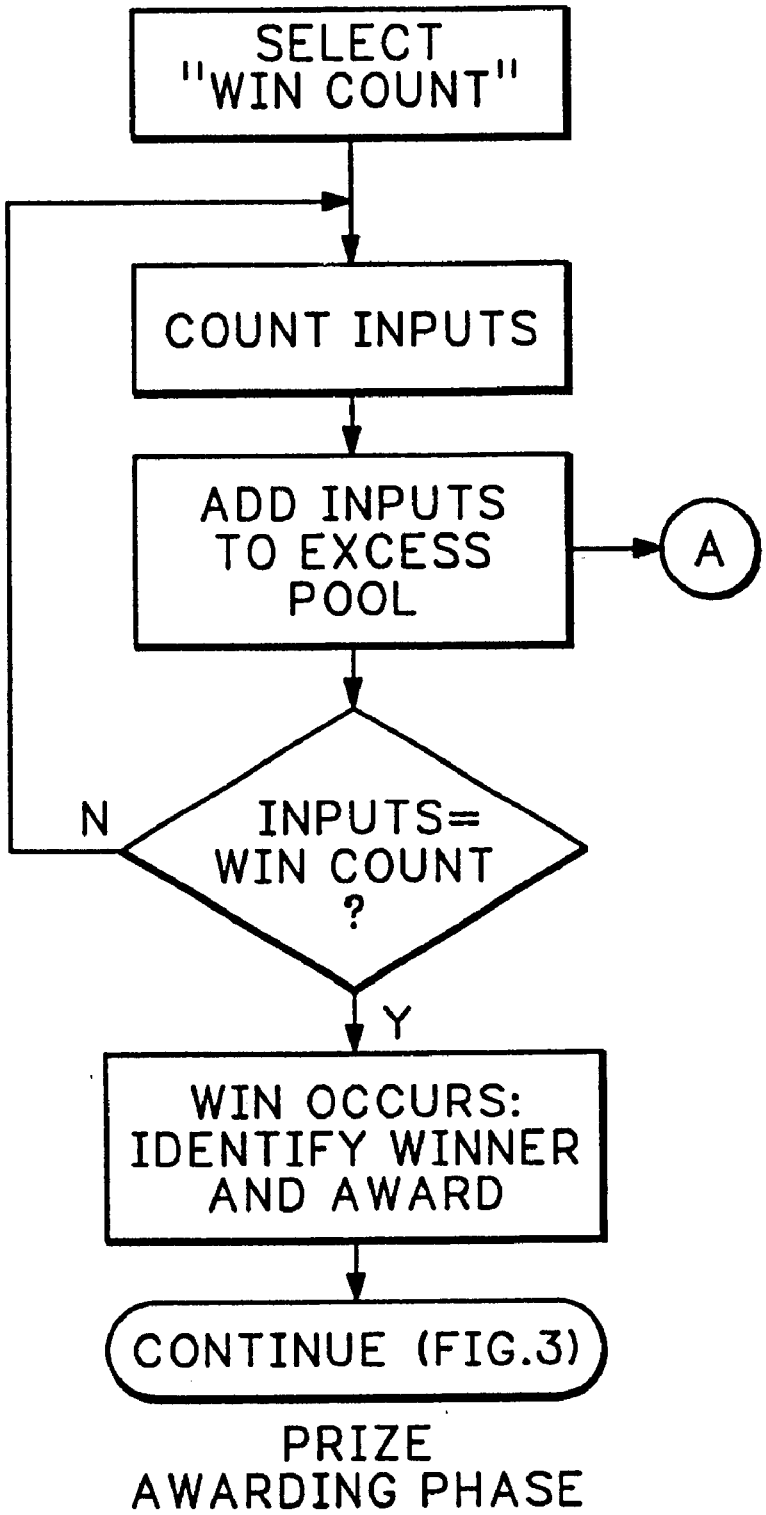
FIG. 5 is a flow diagram of the prize awarding phase.

Next, the prize awarding phase is entered, as will be described with reference to FIG. 5.

Firstly, a "win count" value is randomly selected, in this example being the 100th play. That is, it is not necessarily dependent upon the monetary value wagered, although the units wagered may be an additional factor. Every player of machines 1–5 thus has an opportunity to win the known prize value. It remains the requirement that the prize awarding phase is independent of the prize accumulation phase, and the player causing the prize accumulation phase to end will not, as a matter of course, be the ultimate winner.

Next, each input play event is counted by the central processor 54 and, importantly, the units wagered are separately accumulated in an "excess pool" within the memory 55.

The processor 54 then determines whether the number of input events is equal to the win count. If not, the process repeats. If so, a win occurs and the identity of the gaming machine whose play achieves the equality is recorded and displayed at least on the winning machine's display 24. An indication of the win also may be passed to a display or indicator associated with the winning gaming machine The player now is entitled to redeem the prize.

The cycle now passes to the general "continue" test shown in FIG. 3, and the excess pool value is added to the starting value as previously discussed.

By arranging the bonus prize winning mode into two discrete phases, there is enhanced enjoyment and excitement for players in that once the bonus value is reached, and this fact is known, each player then has a chance to win that prize by continued play.

A further embodiment offers a modification to the sequence already described, in that the "win count" in the prize awarding phase can otherwise be selectable by a system operator as a set value. It will be remembered that the quantum of the prize has been previously determined by the system operator. This quantum can be a fixed amount, the amount in the bonus pool or a non-cash value. A yet further embodiment can be operated in the prize awarding phase so that the "plays" counted are only instances where the play results in a win (i.e. coin-out). Yet further, the inputs counted can be on the basis of the money wagered on each play (i.e. coin-in).

The prize accumulation phase describes in relation to the first embodiment describes accumulation of percentage of coin-in. The accumulation equally could be on the basis of another parameter such as coin-out, games played or time. Many other parameters can be utilized.

A yet further embodiment adds a level of sophistication in the switching between the prize accumulation and prize awarding phases. It is open to determine which ones of the connected gaming machines can participate in the prize awarding phase. One strategy is to await a period of time in the range t=0–30 seconds to sample which connected machines are still active and permitting only those machines to participate in the prize awarding phase. Another strategy can be to allow only those players that participated in the prize accumulation phase to participate in the prize awarding phase. Alternatively, it may be desired to make the prize awarding phase open to "all comers".

What is claimed is:

1. A method for awarding a bonus prize in the play of a plurality of gaming machines, the gaming machines being linked to a central processor having a data memory, the method comprising the steps of:

transmitting, on play of any one gaming machine, a play signal therefrom to said central processor, said signal identifying the transmitting gaming machine;

registering each said play signal as an entry in said memory;

executing a first prize accumulation phase during which a value is accumulated with an initial value for each said play signal up to a level where the accumulatedg value equals a prize value that will be awarded to one of the linked gaming machines; and thereafter executing a prize awarding phase during which said accumulated value remains frozen, and subsequent plays of one or more of the gaming machines are separately counted for their occurrence, and a play of a gaming machine causing the count to equal a prize win count value results in that gaming machine be awarded said prize value.

2. A method as claimed in claim 1, whereby said play signals generated in the prize accumulation phase are based on any one or more of coin-in, coin-out, play duration and quantum of wagers for the respective gaming machine.

3. A method as claimed in claim 1, whereby said play signals generated in the prize awarding phase are based on any one or more of coin-in, coin-out, play duration, number of game plays and quantum of wager for the respective gaming machines.

4. A method as claimed in claim 3, whereby, in the prize awarding phase, the gaming machines contributing to the separate count includes any one of:

(i) all the gaming machines, (ii) only the gaming machines playing during the prize accumulation phase, or (iii) only the gaming machines playing during a short time period reckoned from commencement of the prize awarding phase.

5. A method as claimed in claim 1, including the further step of displaying said accumulated value on indicator means linked to said central processor.

6. A method as claimed in claim 5, comprising the further step of displaying the awarding of the prize value on the respective gaming machine.

7. The method of claim 1 wherein said method further comprises displaying the prize amount during at least a portion of the prize awarding phase.

8. The method of claim 1 wherein said method further includes:

continuing to add a value for each play signal during the prize awarding phase;

accumulating the added value during the prize awarding phase into an excess pool;

initiating a second prize accumulation phase after the prize awarding phase; and using the excess pool as at least a portion of an initial value during the second prize accumulation phase.

9. A gaming machine system having a bonus prize awarding mode in the play of gaming machines, the system comprising:

a plurality of gaming machines for playing games thereon;

a plurality of interface units each coupled with a respective gaming machine to receive a play signal therefrom including the identity of the respective gaming machine;

a central processor having a data memory and being linked to said interface units to receive said play signals;

and wherein said system is operable by said central processor executing a first prize accumulation phase during which a value is accumulated with an initial value for each said play signal up to a level where the accumulated value equals a prize value that will be awarded to one of the linked gaming machines, and thereafter executing a second prize awarding phase during which said accumulated value remains frozen, and subsequent plays of the gaming machines are separately counted for their occurrence, and a play of a gaming machine causing the count to equal a prize win count value results in that gaming machine be awarded said prize value.

10. A system as claimed in claim 9, wherein said play signals generated in the prize accumulation phase are based on any one or more of coin-in, coin-out, play duration and quantum of wagers for the respective gaming machine.

11. A system as claimed in claim 9, wherein said play signals generated in the prize awarding phase are based on any one or more of coin-in, coin-out, play duration, number of game plays and quantum of wager for the respective gaming machines.

12. A system as claimed in claim 11, wherein, in the prize awarding phase, the gaming machines contributing to the separate count includes any one of:

(i) all the gaming machines, (ii) only the gaming machines playing during the prize accumulation phase, or (iii) only the gaming machines playing during a short time period reckoned from commencement of the prize awarding phase.

13. A system as claimed in claim 9, further comprising display means linked to said central processor on which said accumulated value is displayed.

14. A system as claimed in claim 13, wherein the awarding of a prize value is displayed on the display means and/or the respective gaming machine.

15. The method of claim 9 wherein said method further comprises displaying the prize amount during at least a portion of the prize awarding phase.

16. The method of claim 9 wherein said method further includes:

continuing to add a value for each play signal during the prize awarding phase;

accumulating the added value during the prize awarding phase into an excess pool;

initiating a second prize accumulation phase after the prize awarding phase; and using the excess pool as at least a portion of an initial value during the second prize accumulation phase.

17. A method of operating gaming devices interconnected by a network to a central processor comprising:

determining a prize amount;

transmitting an identifying signal from each gaming device to the central processor responsive to play of the gaming devices;

using the processor to track the amount of money played on the gaming devices;

allocating a portion of the money played on the gaming devices to a bonus pool during a prize accumulation phase;

thereafter continuing to transmit an identifying signal from each gaming device to the central processor responsive to play of the gaming devices during a prize awarding phase;

comparing gaming device play during the prize awarding phase to a predefined level of gaming device play; and awarding the prize amount to a selected gaming device after the gaming device play during the prize awarding phase equals the predefined level of gaming device play.

18. The method of claim 17 wherein said method further comprises displaying the prize amount during at least a portion of the prize awarding phase.

19. The method of claim 17 wherein said method further includes:

continuing to use the processor to track the amount of money played on the gaming devices during the prized awarding phase;

allocating a portion of the money played on the gaming devices to an excess pool during the prize awarding phase; and adding the excess pool to the bonus pool after the prize awarding phase.

* * * * *